US006494642B1

(12) United States Patent
Daly

(10) Patent No.: US 6,494,642 B1
(45) Date of Patent: Dec. 17, 2002

(54) ADJUSTABLE CHANNEL INSTALLATION BRACKET

(76) Inventor: Timothy J. Daly, One Kaiser Plaza, Ste. 2360, Pollack Pines, CA (US) 94612

( * ) Notice: Subject to any disclaimer, the term of this patent is extended or adjusted under 35 U.S.C. 154(b) by 0 days.

(21) Appl. No.: 09/540,419

(22) Filed: Mar. 31, 2000

(51) Int. Cl.[7] ..... F16M 11/00

(52) U.S. Cl. ..... 405/36; 248/201; 248/229.12; 248/228.3

(58) Field of Search ..... 248/228.1, 228.3, 248/228.5, 70, 72, 73, 201, 229.12, 229.14; 405/36

(56) References Cited

U.S. PATENT DOCUMENTS 971,438 A * 9/1910 Gillitt ..... 248/228.3
1,303,424 A * 5/1919 Wahlberg ..... 248/228.3
1,658,956 A * 2/1928 Wehr ..... 248/228.3
RE17,629 E * 3/1930 Wehr ..... 248/228.3
1,768,543 A * 7/1930 Clausing ..... 248/228.3
1,974,628 A * 9/1934 Presley ..... 248/228.3
2,877,974 A * 3/1959 Estes ..... 248/228.3
3,368,782 A * 2/1968 Welch ..... 248/72
3,463,428 A * 8/1969 Kindorf et al. ..... 248/72
4,826,113 A * 5/1989 Winters ..... 248/72
4,881,674 A * 11/1989 Medianik ..... 248/228.5
5,112,015 A * 5/1992 Williams ..... 248/228.3
5,711,397 A * 1/1998 Flora et al. ..... 248/229.12

* cited by examiner

*Primary Examiner*—Thomas B. Will
*Assistant Examiner*—Alexandra K. Pechhold
(74) *Attorney, Agent, or Firm*—Bruce & McCoy; Ernest H. McCoy

(57) ABSTRACT

An adjustable channel installation bracket for supporting pre-cast drain channels on rebar studs with a support member securable thereto by set screw receptacles formed in the support member and having biased engagement plates engaged to the support member which capture the drain channel therebetween.

10 Claims, 1 Drawing Sheet

ADJUSTABLE CHANNEL INSTALLATION BRACKET

BACKGROUND OF THE INVENTION

1. Field of the Invention

The present invention relates to brackets utilized in the installation of pre-cast drain channels for surface water drainage. When graded ground is provided with engineered surface water drainage, a wide variety of pre-formed trench drains are available to choose from to simplify the drainage surface construction. Pre-formed channels offer design flexibility, ease of installation, and cost savings over hand forming methods. The channels are positioned sequentially, creating a continually shaped channel run. Installation of the channels requires them to be suspended or positioned in a drain trench usually secured to an adjacent concrete pour form or a structure to be embedded in the concrete. The channel must be secured in a rigidly fixed position so that it will maintain proper alignment and height during the concrete pour.

In a preferred method of pre-formed channel installation, concrete is poured into the drain trench to surround the bottom and sides of the channel so that the top of the channel is level with the top of the finished concrete drain surface. Reinforcing bar stock, rebar, is secured in position to be embedded in the concrete below and/or surrounding the channel. A bracket is secured to the rebar to hold the channel in position with respect to the rebar and thereby with respect to the finished drainage surface. Securing the channels to the rebar permits accurate alignment of the channels and prevents them from floating during the concrete pour. The bracket which secures the channel to the rebar, to hold the channel in position for the concrete pour, is the subject of the present invention.

2. Description of the Prior Art

A primary type of installation bracket utilized for positioning a pre-formed channel in a drain trench preparatory to a concrete pour has a specialized configuration. A pair of uniquely formed securing clamps is positioned in opposing relation to engage lateral projections disposed on the sides of a pre-formed channel. The clamps are mounted on a U-shaped stand which is secured to the underlying rebar. The stand forms two upward projecting legs which serve to maintain the clamps at the proper height and keep the channels from floating during the concrete pour. A securing bolt, extending between the clamps and the two legs of the U-shaped stand, biases the securing clamps toward the sides of the channel and keeps the entire bracket attached to the channel. The lower crossbar of the U-shaped stand has a pair of holes to permit the stand to be mounted on a pair of upward projecting ends of rebar or studs mounted in the drain trench which is to be filled with concrete.

SUMMARY OF THE INVENTION

The present invention is an adjustable channel installation bracket. It comprises a support member having a pair of receptacles formed at the ends thereof for engaging a pair of free-standing positioning members. A means is provided for adjustably securing the support member to the positioning members. A pair of channel engagement plates are adjustably engaged to the support member for infinitely adjustable positioning therealong. The plates project perpendicularly from the support member and are formed for engaging a pre-formed channel The bracket includes a tensioning means for biasing the plates to capture a channel therebetween.

OBJECTS OF THE INVENTION

It is therefore an important object of the present invention to provide a new and novel bracket for securing pre-formed drain channels to structural rebar.

It is another object of the present invention to provide a design for a bracket for installing pre-formed channels which permits adjustable height positioning on the underlying and upward projecting supporting structure.

It is a further object of the present invention to provide a design for a bracket for installing pre-formed channels which permits unlimited lateral movement of the side clamps for installing different width channels.

It is still another object of the present invention to provide a design for a bracket which permits infinite lateral adjustment of the side clamps for permitting perfect lateral alignment of the successive channels.

It is yet a further object of the present invention to provide a simplified design for a bracket for installing pre-formed channels which can be made from sheet and bar stock metal.

And it is yet another object of the present invention to provide a new and novel bracket for installing pre-formed channels which is relatively inexpensive to manufacture and does not require complex or costly machining tools.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
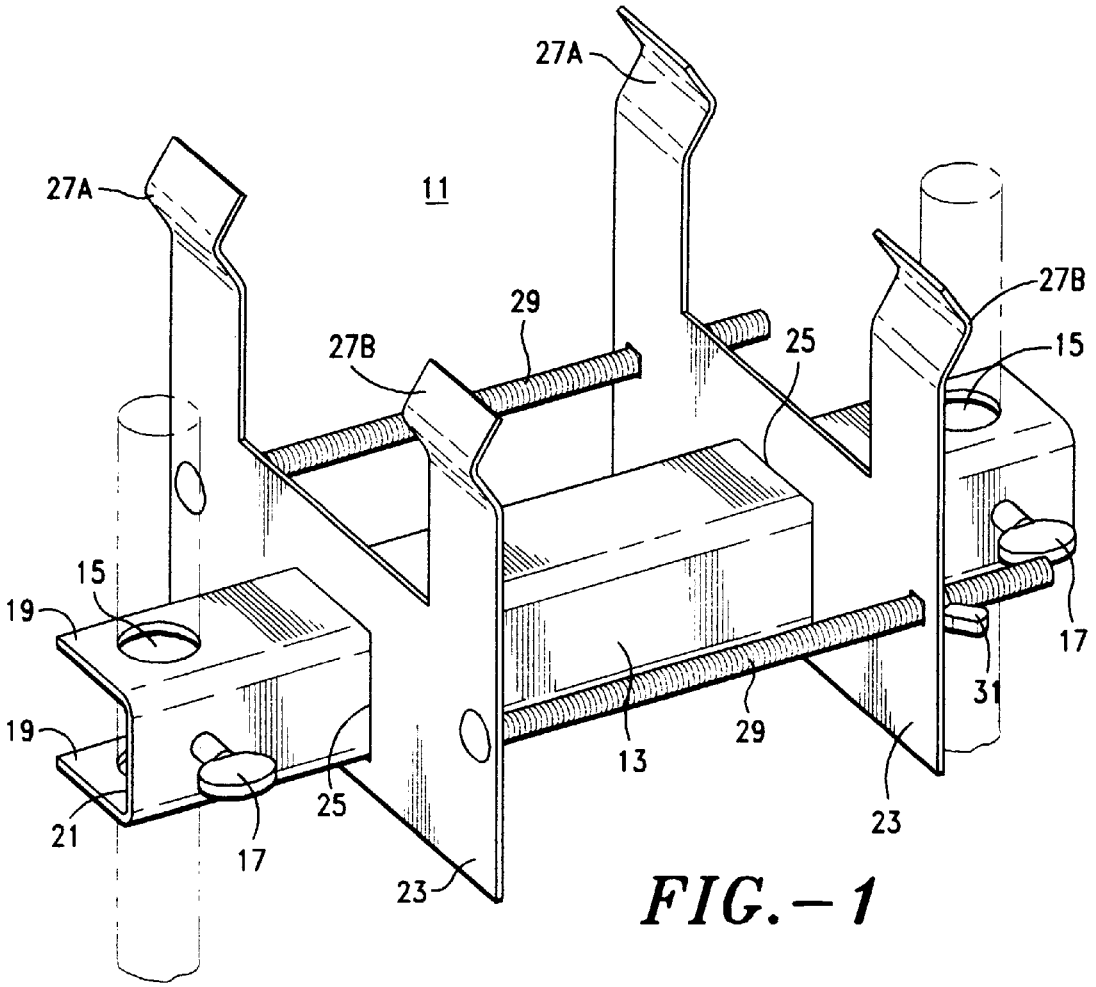
FIG. 1 is a perspective view of the adjustable channel of the present invention.
Figure 2:
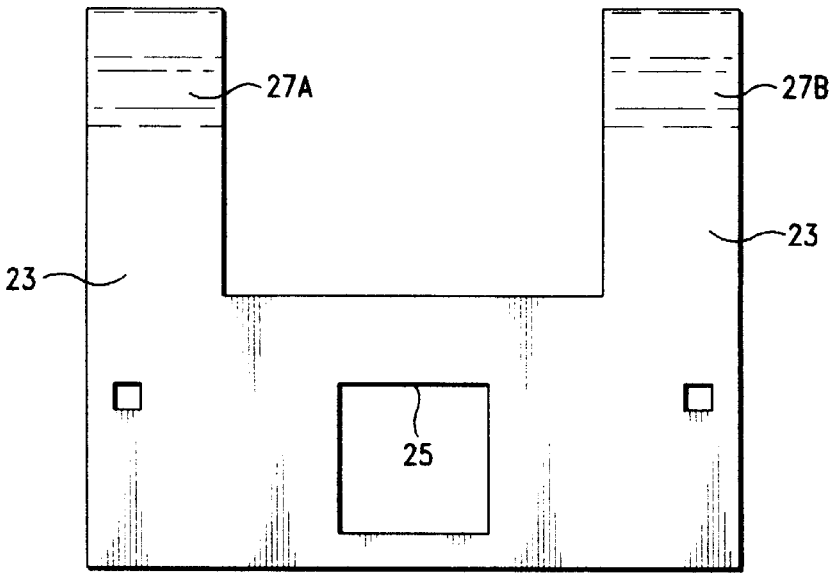
FIG. 2 is a side elevation of the bracket engagement plate.

FIG. 1 shows a preferred embodiment of the adjustable channel installation bracket 11 of the present invention formed for mounting in a drainage trench to support a pre-formed drain channel. The channel is mounted on a pair of rebar studs before concrete is poured into the trench to create a surface water drainage topography.

A basic support member 13 is provided with means for engaging free-standing positioning members (not shown) such as a pair of upward projecting rebar studs. The engaging means can be comprised of receptacles 15 for receiving the positioning members. The receptacles are usually positioned at the ends of the support member but can be positioned anywhere therealong and can be singular or include a multiplicity thereof. A means, such as set screws 17, is provided for adjustably securing the support member to the positioning members.

Generally, reinforcing bars are utilized to stabilize a concrete slab when a drainage surface is created. However, in the absence of rebar, other structures could be placed in the trench to provide the positioning members for mounting the bracket and drain channel In the optimum situation, the positioning members are implanted under or below the position in which the channel is to be imbedded in the concrete in order to permit construction of a balanced support structure.

In the preferred embodiment of the invention, the support member 13 is formed from a piece of C-section channel material. The preferred material is mild steel C-section bar stock. The C-section channel is formed with a pair of parallel plates and a web plate or connecting wall 21. A plastic or other molded or extruded material will serve the purpose of forming the support member because it is eventually encased in concrete and ceases to serve any support function thereafter.

The means for adjustably securing the support member 13 to the rebar positioning members includes in the preferred embodiment at least a pair of receptacles 15 formed in the support member to receive and engage the positioning members. It is possible that the support member could be mounted on a single positioning stud, requiring only a single receptacle but for standard size surface water drains, that arrangement would be very unstable. However, a single receptacle would be the equivalent of a pair of receptacles in certain specialized situations.

The receptacles 15 formed in the preferred embodiment of the support member 13 are a pair of aligned openings formed in the parallel plate sections 19 of the C-section bar stock. The length of bar stock forming the support member, and the positioning of the receptacles, is infinitely variable and determined by the width of the pre-formed drain channel or the positioning of the rebar studs. A wide channel may require more than just a pair of receptacles for receiving a multiplicity of positioning members.

The means provided for adjustably securing the support member 13 to the rebar positioning members also includes a locking mechanism which works in conjunction with the receptacles 15 to secure the support member at the proper height on the positioning members. The locking mechanism in its simplest form is a biasing means which biases the positioning members in the receptacles to prevent movement of the positioning members therein, and many locking mechanisms are capable of serving this purpose.

In the preferred embodiment of the invention, a pair set screws 17 or thumb screws are threadably engaged with the web plate or connecting wall 21 of the C-section channel member 13 in a position to bear against the re-bar positioning members extending or projecting through the receptacles 15 in the channel. When the support member is arranged or disposed at the desired or proper elevated position on the rebar studs, the thumb screws are tightened to fix the positioning of the channel height on the positioning members. The thumb screws bear against the rebar stud and pull the support member thereagainst where it is biased and held by friction on the rough rebar surface so it cannot slip up or down on the end of the rebar stud. Other adjustable securement means, such as clamps secured to the support member which engage the stud, or the reverse, clamps on the stud to engage the support member, or wedges or cams which force the rebar into non-sliding contact with the support members, will serve the function equally as well but usually are not as simple to manufacture or as expedient to operate as the set screw arrangement.

A pair of channel engagement plates 23 are adjustably engaged to the support member 13 and formed for infinitely adjustable positioning there along. The plates project perpendicularly from the support member to form vertically upward projecting panels. The plates are not secured to be support member, apart from the locking engagement therewith, whereby they can slide laterally along the support member to the position dictated by the required positioning and width of the channel that is being captured between the engagement plates. This is an important feature because the underlying positioning members are generally not accurately located and, as a result of the present design, do not need to be. The engagement plates must be adjustable along the support member to both center the clamped channel in perfect alignment and to permit accommodation of different width channels. The present invention permits infinite adjustment of the separation and positioning of the engagement plates along the support member.

To create this capability, the engagement plates 23 are provided with an opening 25 which is slightly larger than, but conforms generally to, the external cross-section configuration of the support member 13. In the preferred embodiment of the invention, a square hole is punched in the engagement plates, but it could have other configurations, such as a square "C" to conform to the preferred support member, or any other configuration to conform to other support member cross-section designs. The engagement plates are formed at the upper ends thereof 27 for engaging the preformed drain channel (not shown).

The formed portions 27 of the engagement plates 23 are clamping means disposed at opposing locations thereon which engage or receive a specific portion of the external surface configuration of a drain channel disposed between the plates. The lower opposite edges of the pre-formed drain channels (not shown) are usually provided with flanges which can be gripped by the formed portions 27 of the plates. The engagement plates can be relieved by removing an intermediate portion of the upper ends of the plates to save material cost. More importantly, by creating two pairs of opposing clamping brackets 27A and 27B, the pairs of brackets can clamp independently onto the drain channels sections and accommodate minor misalignment of the channels which are supported therein.

In their simplest form, the formed portions 27 of the engagement plates 23 are simply indentations in the form of V-shaped troughs, or large grooves, stamped into the plates to form opposing flange receptacles. Both plates are identical for manufacturing simplicity and cost savings. One is reversed when mounted on the support member 13 so that they are disposed in opposed relation to capture projecting portions of a channel in the respective opposing indentations.

A tensioning means is provided for biasing the engagement plates 23 to capture the pre-formed channels there between. In the preferred embodiment of the invention, a threaded member 29 extends between the plates to interconnect them. It can be actuated by rotary motion to bias the engagement plates toward each other infinitely incrementally. In the simplest conception, it is comprised of a bolt with a thumb tightenable wing nut 31. For the preferred embodiment, in its least expensive practical form, the tensioning means is comprised of a pair of threaded stove bolts which interconnect the two plates for stress and static balance.

To utilize the device, the bracket 11 has to be secured to a pair of positioning members such as rebar studs mounted in a drain trench. The bracket is usually set on just two studs so that they project upwards through the pair of receptacles 15 disposed at opposite ends of the support member 13 of the bracket. The pre-formed drain channel is then positioned and clamped between the engagement plates 23 by tightening the wing nuts 31 on the pair of threaded bolts 29 which comprise the tensioning means. The nuts on the bolts are tightened until the engagement plates contact the channel and self-adjust on the support member. The drain channel is laterally aligned with the adjacent channels by sliding the engagement plates along the support member to the proper position. No further securement of the plates to the support member is required. The support member then is lifted on the rebar studs to the proper height for vertical alignment of the drain channels. The set screws 17 are then tightened until they support and lock the channel in the desired position on the rebar stud positioning means. When concrete is poured in the drain trench, the bracket of the present invention is encased therein and holds the drain channel in proper position while the concrete sets and hardens.

The preferred embodiment of the invention is a new and novel improvement over the described prior art of installation brackets. It is provided with a means for adjustable height positioning on the underlying and upward projecting rebar studs for infinite vertical alignment of the drain channel. Most importantly, it permits infinite lateral adjustment for longitudinal alignment of the drain channel while at the same time the infinite lateral adjustment permits accommodation of different width channels with infinite size adjustment. A further special advantage of the present invention is that the parts can be cut from common C-section bar stock and stamped from sheet metal with simple tools, supplemented by common bolts and nuts. The bracket is therefore inexpensive and simple to manufacture, and can be installed very rapidly, usually by hand or with just a pair of pliers.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. An adjustable channel installation bracket for supporting and holding a section of drain channel in an elevated position during a concrete pour comprising an elongated fixed length horizontal support member having means including at least one receptacle formed therein for engaging at least one free-standing vertical positioning member of concrete reinforcing bar stock, said receptacle permitting vertical movement of said support member on said positioning member, engagement means disposed proximate to said receptacle for adjustably securing said support member to said positioning member at selectable variable elevations thereon, a pair of channel engagement plates having lower ends thereof adjustably engaged to said horizontal support member for infinitely adjustable independent positioning therealong, said plates projecting vertically upward from said support member and having upper ends thereof formed for engaging a pre-formed drain channel, and tensioning means for biasing said plates to capture said drain channel therebetween.

2. The adjustable drain channel installation bracket of claim 1 wherein said support member is comprised of a length of C-section channel material and said means for engaging said positioning members includes at least a pair of aligned receptacles formed in the parallel plates of said C-section material of said support member to receive said positioning members extending therethrough.

3. The adjustable drain channel installation bracket of claim 2 wherein said means for adjustably securing said support member to said positioning member includes biasing means engaged with said support member and formed to bias said support member into engagement with said positioning members at any position therealong.

4. The adjustable drain channel installation bracket of claim 1 wherein said engagement means for adjustably securing said support member to said positioning members includes at least one set screw threadably engaged to said support member and formed for bearing against said positioning member when said member is engaged with said support member to hold said support member in fixed position with respect to said positioning member.

5. The adjustable drain channel installation bracket of claim 1 wherein said upper ends of said engagement plates are provided with formed clamping means disposed at opposing locations thereon comprised of outward projecting drain channel conforming receptacles formed to receive a specific preformed portion of the lower external surface of a channel disposed between said plates.

6. The adjustable drain channel installation bracket of claim 5 wherein said engagement plates are each comprised of at least a pair of independent clamping brackets extending from said upper ends of said plates.

7. The adjustable drain channel installation bracket of claim 1 wherein said tensioning means for causing said plates to engage and clamp a drain channel therebetween includes at least a threaded member which interconnects said plates and can be actuated by rotation of said member to bias said engagement plates toward each other infinitely incrementally.

8. The adjustable drain channel installation bracket of claim 7 wherein said tensioning means is comprised of at least a pair of threaded bolts which engage opposite ends of said plates.

9. The adjustable drain channel installation bracket of claim 2 wherein said means for engaging said positioning member includes two pairs of aligned receptacles formed in said parallel plates of said C-section material and disposed at opposite ends of said support member.

10. An adjustable drain channel installation bracket for supporting and holding said drain channel in position during a concrete pour comprising an elongated horizontal support member formed of a length of C-section channel material, said support member having pairs of aligned openings formed in the parallel plate sections of said C-section material disposed at the opposite ends thereof for engaging a pair of free standing vertical positioning members of concrete reinforcing bar stock extending therethrough at variable elevations thereon, biasing means cooperating with said openings to bias said support member into engagement with said positioning members, a pair of channel engagement plates adjustably engaged to said support member for infinitely adjustable positioning therealong, said plates projecting perpendicularly upward from said support member and having upper ends thereof forming at least a pair of brackets having outward projecting drain channel conforming receptacles formed at opposing locations thereon disposed to engage a specific preformed portion of the external lower surface of a drain channel disposed between said plates, and at least a pair of threaded bolts which engage and interconnect opposite ends of said plates and can be actuated to bias said engagement plates toward each other to grasp a drain channel disposed therebetween.

* * * * *